US007173533B1

(12) United States Patent
Beron et al.

(10) Patent No.: US 7,173,533 B1
(45) Date of Patent: Feb. 6, 2007

(54) SYSTEM AND METHOD FOR ALERTING SPORTS PARTICIPANTS WHO CANNOT DETECT AUDIBLE SIGNALS

(76) Inventors: Celia Claire Beron, 2 Gettysburg La., Richardson, TX (US) 75080; Kurt James Beron, 2 Gettysburg La., Richardson, TX (US) 75080

( * ) Notice: Subject to any disclaimer, the term of this patent is extended or adjusted under 35 U.S.C. 154(b) by 187 days.

(21) Appl. No.: 10/928,007

(22) Filed: Aug. 27, 2004

(51) Int. Cl.
*G08B 23/00* (2006.01)

(52) U.S. Cl. ..... 340/573.1; 340/825.19; 340/539.11; 341/21

(58) Field of Classification Search ..... 340/407.1, 340/825.19, 311.2, 539.11, 573.1; 341/21, 341/176
See application file for complete search history.

(56) References Cited

U.S. PATENT DOCUMENTS 5,507,246 A 4/1996 Rand, Jr.
6,181,236 B1 * 1/2001 Schneider, Jr. ..... 340/326
6,326,901 B1 * 12/2001 Gonzales ..... 340/7.2
6,794,989 B2 * 9/2004 Naegely et al. ..... 340/573.1

OTHER PUBLICATIONS

Gadget of the Day, http://www/howstuffworks.com/gadget142.htm, (2 pages).
Universal Sound Signaler, http://www.teltexinc.com/products/assistive/ssd/sh/ (1 page).
"Hearing or deaf, soccer teams play to win", The Cincinnati Enquirer, http://www.enquirer.com/editions/2001/05/27/tem_kendrick_hearing_or.html (2 pages), May 27, 2001.
"UNF student named to U.S. deaf soccer team", University of North Florida, http://www.unf.edu/development/news/insideunf/03%20april/socer.html (2 pages), Apr. 20, 2003.

* cited by examiner

*Primary Examiner*—Daniel Wu
*Assistant Examiner*—Travis Hunnings
(74) *Attorney, Agent, or Firm*—Baker Botts L.L.P.

(57) ABSTRACT

According to an embodiment of the present invention, an alerting system includes an activation device coupled to a first human and operable to emit a first signal, a transceiver coupled to the first human and operable to detect the first signal and emit a second signal in response thereto, a receiver coupled to a second human and operable to receive the second signal, and an indicator coupled to the receiver and operable to activate in response to receipt of the second signal.

12 Claims, 3 Drawing Sheets

SYSTEM AND METHOD FOR ALERTING SPORTS PARTICIPANTS WHO CANNOT DETECT AUDIBLE SIGNALS

TECHNICAL FIELD OF THE INVENTION

The present invention relates in general to signaling devices in sporting events and, more particularly, to a system and method for alerting sports participants who cannot detect audible signals.

BACKGROUND OF THE INVENTION

Sports participants depend on auditory cues to alert them of certain occurrences during sporting events. For instance, the firing of an official's starter pistol may indicate the start of a race, the blowing of a referee's whistle may indicate the end of a play, and the yelling of a coach may indicate a need for a timeout.

If a sports participant is deaf or has difficulty hearing, then he or she may not be able to detect these auditory cues. Instead, he or she may depend on sign language and other visual cues to gather information and communicate with others. However, sign language and other visual cues do not alleviate the problem when the sports participant is not aware that the coach or the referee is trying to alert him or her in the first place. This occurrence often happens because neither the coach nor the referee is in the line of sight of the participant. Consequently, the participant may continue to play oblivious to auditory cues indicating a stoppage in play. This continuing of play could ultimately lead to team miscues, lost championships, and even physical injury.

SUMMARY OF THE INVENTION

According to an embodiment of the present invention, an alerting system includes an activation device coupled to a first human and operable to emit a first signal, a transceiver coupled to the first human and operable to detect the first signal and emit a second signal in response thereto, a receiver coupled to a second human and operable to receive the second signal, and an indicator coupled to the receiver and operable to activate in response to receipt of the second signal.

Some embodiments of the present invention provide various technical advantages. For example, in one embodiment, the present invention enables sports participants to detect signals from the referee by means other than auditory cues. In another embodiment, the present invention enables sports participants to detect signals from the coach by means other than auditory cues. By improving sports participants' ability to detect these signals from the referee and coach, the system reduces the risk of miscues, foul play, and physical injuries. The system is particularly useful for aiding sports participants who are deaf or have difficulty hearing. Other technical advantages may be readily ascertainable by those skilled in the art from the following figures, descriptions, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

FIG. 1 is a schematic illustrating an alerting system 100 in accordance with one embodiment of the present invention. Although system 100 is illustrated as being utilized in the context of a soccer match, the present invention contemplates system 100 being utilized in other suitable contexts. In the illustrated embodiment, system 100 includes a sports field 120, a first human 140, and a second human 160.

Figure 1A:
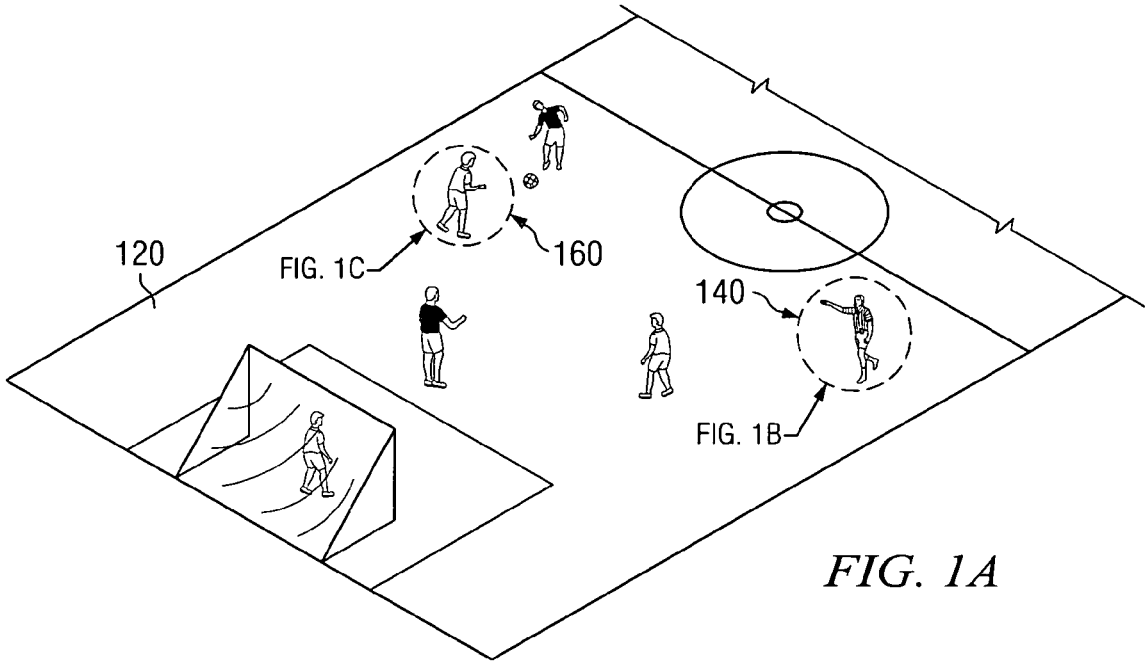
FIG. 1 is a schematic illustrating an alerting system, in accordance with one embodiment of the invention.

Illustrated in FIG. 1A, sports field 120 is depicted as a soccer field; however, sports field 120 may be other fields or areas suitable for sports, such as a track and field arena, a baseball field, and a swimming pool.

Figure 1C:
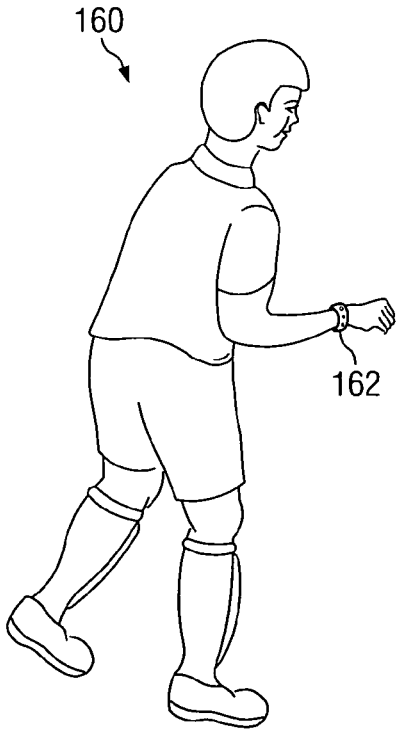
Figure 1B:
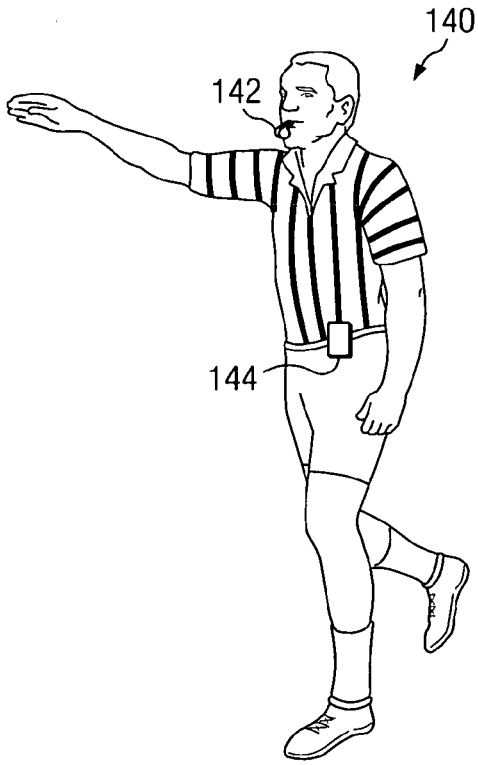

Illustrated in FIGS. 1A and 1B, first human 140 is depicted as a referee; however, first human 140 may be other suitable humans, such as a coach and a track official. First human 140 includes an activation device 142 and a transceiver 144. In the illustrated embodiment, activation device 142 is a whistle; however, activation device 142 may be other devices configured to send a first signal 180 (as referenced in FIG. 2), such as a remote control and a starter pistol for a track race. Transceiver 144 is attached to a belt in the illustrated embodiment; however, transceiver 144 may be located on other places on first human 140, such as a pocket, a shirt, and a tie. Generally, first human 140 blows the whistle, thereby activating activation device 142. As described in further detail below, transceiver 144 detects first signal 180 sent by activation device 142 and consequently sends a second signal 182 (as referenced in FIG. 2) in response.

Referring to FIGS. 1A and 1C, second human 160 is depicted as a soccer player; however, second human 160 may be other suitable humans, such as a track and field sprinter, a baseball player, and a swimmer. Second human 160 includes a band 162 that houses a receiver 164 and indicators 166 (as referenced in FIG. 2). In the illustrated embodiment, band 162 is a wristband; however, band 162 may be other suitable clothing accessories, such as an armband, an ankle band, and a belt. Generally, receiver 164 housed in band 162 detects second signal 182 sent by transceiver 144. Subsequently, second human 160 is alerted by indicators 166 housed in band 162. Second human 160 then knows to divert his attention away from the play and towards first human 140.

Figure 2:
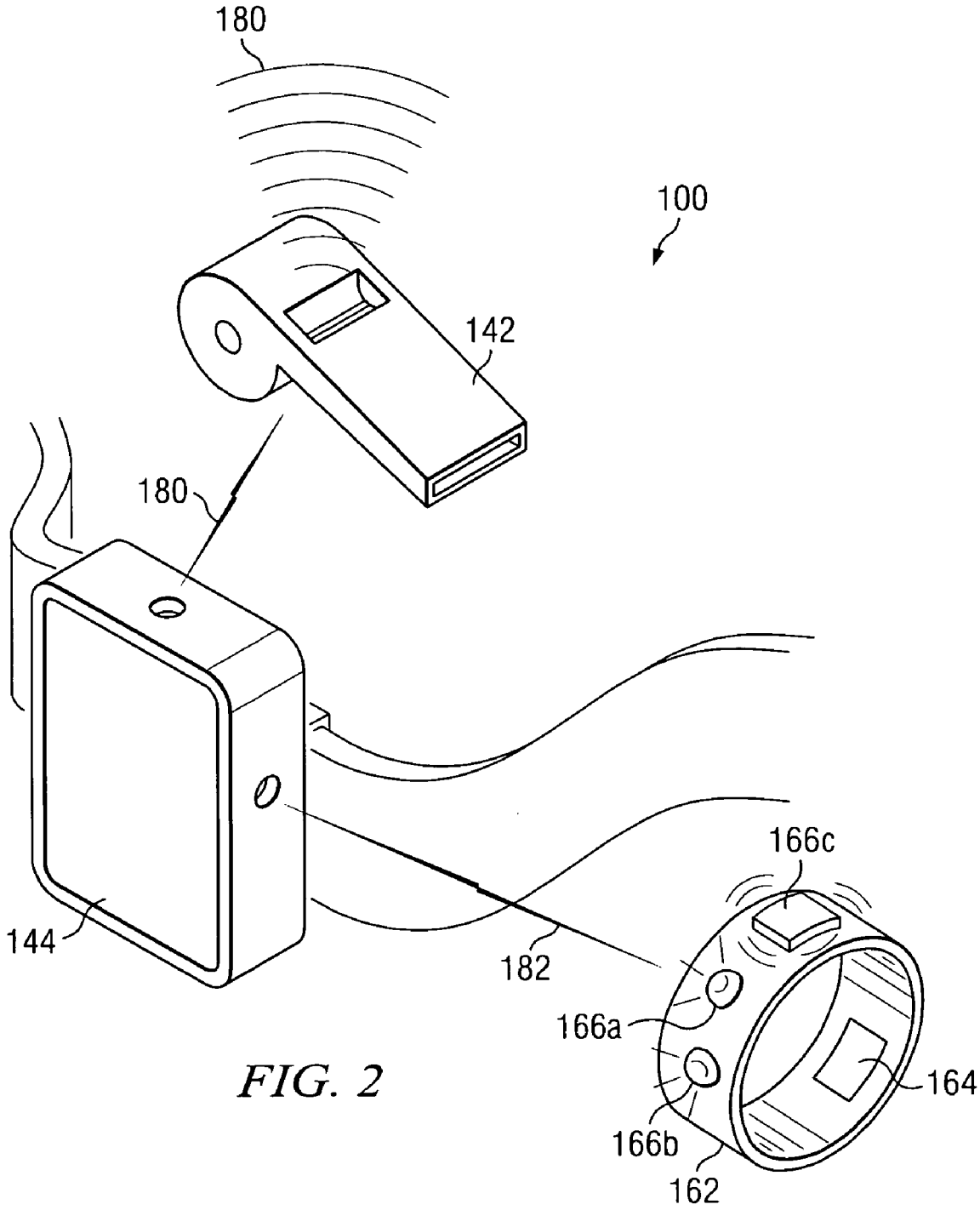
FIG. 2 is a diagram illustrating an alerting system comprising an activation device, a first signal, a transceiver, a second signal, and a band, which houses a receiver and indicators, in accordance with one embodiment of the invention.

FIG. 2 is a diagram illustrating alerting system 100 comprising activation device 142, first signal 180, transceiver 144, second signal 182, and band 162, which houses receiver 164 and indicators 166, in accordance to one embodiment of the present invention.

Activation device 142 is operable to transmit first signal 180, which may be any suitable signal, such as an auditory signal, an electrical signal, and a radio signal. In the illustrated embodiment, activation device 142 is a whistle and is operable to transmit first signal 180, an audio signal, when first human 140 blows the whistle. In an alternative embodiment, activation device 142 is a remote control operable to transmit first signal 180, which may be an electrical signal or a radio signal, when first human 140 pushes a button on the remote control. In another embodiment, activation device 142 is a starter pistol operable to transmit first signal 180, an audio signal, when first human 140 fires the starter pistol. In addition, activation device 142 may be other devices operable to transmit first signal 180. In the illustrated embodiment, first signal 180, which is an audio signal, lies within any suitable frequency and amplitude range. As will be described in further detail below, transceiver 144 is configured to detect first signal 180 that falls within this frequency and amplitude range. Transmission and detection of audio, electrical, radio signals are well-known in the art and need not be described in further detail.

Transceiver 144 is operable to detect first signal 180 and transmit second signal 182 in response thereto. Second signal 182 is a radio signal in the illustrated embodiment, but may be any other type of signal suitable to be transmitted to receiver 164 located on second human 160. Transceiver 144 may be positioned on first human 140 clipped to a belt, placed inside a pocket, or in any other suitable location so that transceiver 144 is operable to detect first signal 180. Generally, transceiver 144 is configured to operate at a pre-selected frequency and amplitude range, which will correspond to the frequency and amplitude range of first signal 180, through the use of a bandpass filter or any other suitable filtering device. Thus, transceiver 144 may detect only first signal 180 and not any other signals or noise. In an alternative embodiment where activation device 142 is a remote control and first signal 180 is an electrical signal, activation device 142 and transceiver 144 may be connected via an electrical wire, through which transmission of first signal 180 occurs. Alternatively, activation device 142 may transmit first signal 180 to transceiver 144 via wireless transmission.

In another embodiment of the present invention, transceiver 144 may be configured to detect multiple signals. For example, transceiver 144 is configured to detect first signal 180 and an additional signal. First signal 180 is transmitted from activation device 142 that is a whistle and the additional signal is transmitted from another activation device 142 that is a remote control. In this embodiment, transceiver sends second signal 182 in response to detection of first signal 180 or the additional signal. Second signal 182 is a radio signal transmitted at a pre-selected frequency range and carries information as to whether first signal 180 or the additional signal was detected.

Band 162 houses receiver 164 and indicators 166. In the illustrated embodiment, band 162 is depicted as a wristband; however, band 162 may be any type of clothing or clothing accessory suitable to house receiver 164 and indicators 166. As described above, band 162 is positioned on second human 160. Receiver 164 is configured to operate at a pre-selected frequency range, which corresponds to the frequency range of second signal 182 through the use of a bandpass filter, or any other suitable filtering device. Thus, receiver 164 may detect only second signal 182 and not any other signals or noise. Upon detection of second signal 182 by receiver 164, indicators 166 activate in response thereto.

In the illustrated embodiment, indicators 166 comprise light bulbs 166*a* and 166*b* and a vibrating device 166*c*; however, indicators 166 may be any suitable device operable to alert second human 160, such as a digital display. In the illustrated embodiment, light bulbs 166*a* and 166*b* activate by illuminating in response to detection of second signal 182 by receiver 164. For example, in the embodiment described above where transceiver 144 is configured to detect multiple signals, indicators 166*a* and 166*b* may be different colored light bulbs that are each matched to one of the two signals, respectively. Light bulb 166*a* may be colored red and operable to activate in association with first signal 180. Similarly, light bulb 166*b* may be colored green and operable to activate in association with the additional signal.

Vibrating device 166*c* activates by vibrating in response to detection of second signal 182 by receiver 164. If transceiver 144 is configured to detect multiple signals, indicator 166*c* may vibrate in association with first signal 180 only or the additional signal only, or both.

Indicators 166 are operable to activate for a preconfigured length of time. After the length of time has passed, indicators 166 are deactivated and are operable to activate again upon the next detection of a signal by receiver 164. In an alternative embodiment, indicators 166 may also be configured to deactivate when second human 140 manually deactivates indicators 166.

Figure 3:
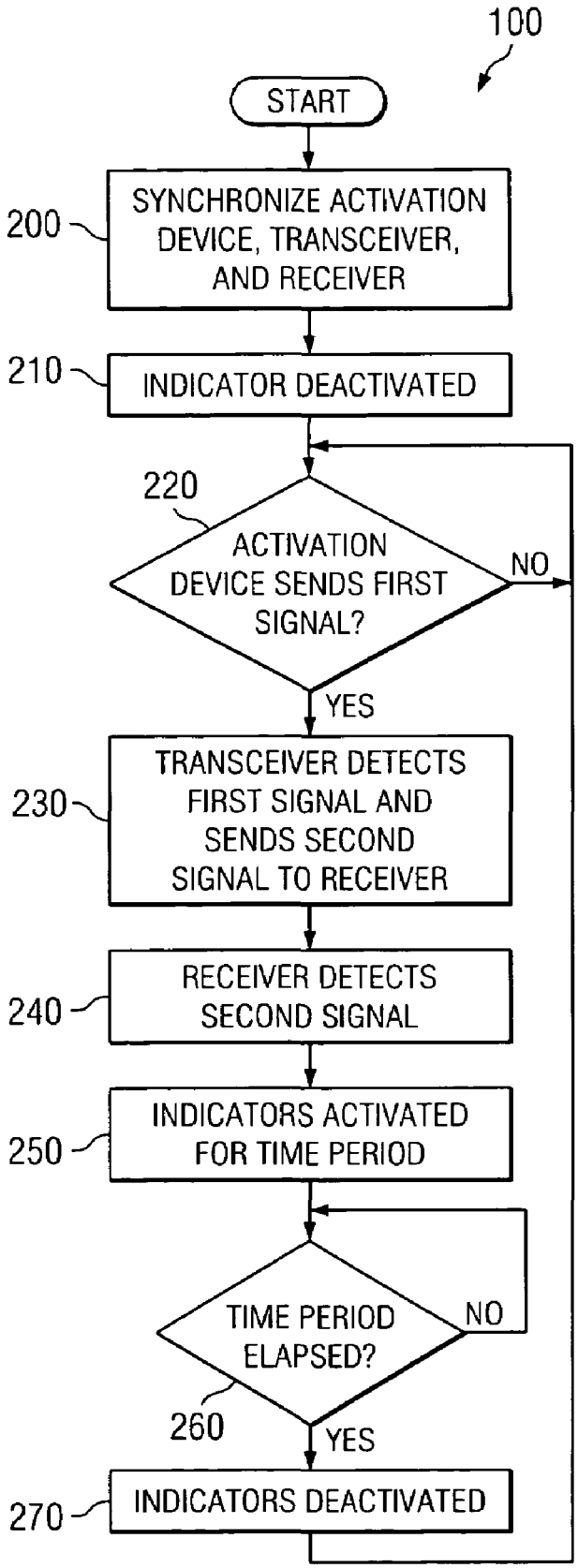
FIG. 3 is a flowchart illustrating a method for alerting sports participants according to one embodiment of the invention.

FIG. 3 is a flowchart illustrating a method for alerting sports participants according to one embodiment of alerting system 100. System 100 begins at step 200, where activation device 142 is synchronized with transceiver 144 and receiver 164. During synchronization, transceiver 144 is configured to detect first signal 180 that is transmitted by activation device 142. Similarly, receiver 164 is configured to detect second signal 182 that is transmitted by transceiver 144. At step 210, indicators 166 are deactivated. At decisional step 220, if activation device 142 does not transmit first signal 180, the method remains at decisional step 220 until activation device 142 transmits first signal 180. If activation device 142 transmits first signal 180, transceiver 144 detects first signal 180 and transmits second signal 182 in response thereto, as indicated by step 230. Subsequently, at step 240, receiver 164 detects second signal 182 and at step 250, indicators 166 activate for a pre-selected time period in response thereto. In a particular embodiment, indicators 166 comprise light bulbs 166*a* and 166*b*, which activate by illuminating, and vibrating device 166*c*, which activates by vibrating. If the time period has not elapsed at decisional step 260, indicators 166 remain activated. If the time period has elapsed at decisional step 260, indicators 166 are deactivated at step 270. The method then continues at step 210, so that activation device 142 may transmit another first signal.

Although the present invention has been described in detail with several example embodiments, a myriad of changes and modifications may be suggested to one skilled in the art, and it is intended that the present invention encompass such changes and modifications as they fall within the scope of the claims.

What is claimed is:

1. An alerting system, comprising:

a whistle coupled to a referee and operable to emit a first signal;

a transceiver coupled to the referee and operable to detect the first signal and emit a second signal in response thereto;

a remote control device coupled to a coach and operable to emit a third signal;

a receiver coupled to a sports participant and operable to receive the second signal and the third signal;

a light coupled to the receiver comprising a first light bulb and a second light bulb, the first light bulb operable to illuminate in response to the receipt of the second signal, the second light bulb operable to illuminate in response to the receipt of the third signal;

a vibrating device coupled to the receiver and operable to vibrate in response to receipt of the second signal or the third signal.

2. The system of claim 1, wherein the first and second light bulbs are different colors.

3. The system of claim 1, further comprising a band coupled to the sports participant and configured to house the light and the vibrating device.

4. An alerting method for a sports participant, comprising emitting a first signal from a first activation device activated by a referee;

detecting the first signal by a transceiver;

emitting a second signal from the transceiver in response to the first signal;

emitting a third signal from a second activation device activated by a coach;

receiving the second and third signals at a receiver;

activating a first indicator at the receiver in response to the second signal; and activating a second indicator at the receiver in response to the third signal.

5. The method of claim 4, wherein emitting the first signal from the first activation device comprises blowing a whistle.

6. The method of claim 4, wherein emitting the first signal from the first activation device comprises firing a starter pistol.

7. The method of claim 4, wherein emitting the second signal from the second activation device comprises pushing a remote control button.

8. The method of claim 4, wherein activating the first indicator in response to receiving the second signal comprises illuminating a light.

9. The method of claim 4, wherein activating the first indicator in response to receiving the second signal comprises vibrating a vibrating device.

10. The method of claim 9 claim 4, further comprising housing the first and second indicators in a band.

11. The method of claim 4, wherein activating the second indicator in response to receiving the third signal comprises illuminating a light.

12. The method of claim 4, wherein activating the second indicator in response to receiving the third signal comprises vibrating a vibrating device.

* * * * *